109-49.5 SR
12/30/86 XR 4,632,041

United States Patent [19]
Ohlson

[11] Patent Number: 4,632,041
[45] Date of Patent: Dec. 30, 1986

[54] BLASTING CHAMBER

[75] Inventor: Johnny Ohlson, Karlskoga, Sweden

[73] Assignee: Aktiebolaget Bofors, Bofors, Sweden

[21] Appl. No.: 662,749

[22] Filed: Oct. 19, 1984

[51] Int. Cl.[4] ..... E05G 3/00; E06B 9/00
[52] U.S. Cl. ..... 109/1 S; 109/49.5; 109/85; 52/169.6
[58] Field of Search ..... 109/1 R, 1 S, 24, 26, 109/27, 49.5, 68, 78, 80, 85; 52/167, 169.6; 86/50; 220/446, 447, 437, 439, 445, 469

[56] References Cited

U.S. PATENT DOCUMENTS

| | | | |
|---|---|---|---|
| 2,315,800 | 10/1957 | Rochester et al. | 109/57 |
| 3,660,951 | 5/1972 | Cadwell | 109/1 S |
| 3,672,103 | 6/1972 | Kost | 52/169.6 |
| 4,326,468 | 4/1982 | King et al. | 109/49.5 |

FOREIGN PATENT DOCUMENTS

| | | | |
|---|---|---|---|
| 3185 | of 1869 | United Kingdom | 220/447 |

*Primary Examiner*—Gary L. Smith
*Assistant Examiner*—Neill Wilson
*Attorney, Agent, or Firm*—Pollock, Vande Sande & Priddy

[57] ABSTRACT

This invention relates to a blasting chamber; i.e. a cylindrical container or chamber (1, 2) which can contain high pressure and splinters produced by an explosion. The blasting chamber according to the invention is characterized of its low weight, which has been achieved by an at least partial double wall design with an interior part (1) which is locked up in an exterior part (2) in such a way that any increase of pressure working on the interior part is divided between primarly the jacket wall of the interior part, secondly the end walls (4, 5) thereof and thirdly the jacket wall (12) of the exterior part.

9 Claims, 4 Drawing Figures

FIG. 1
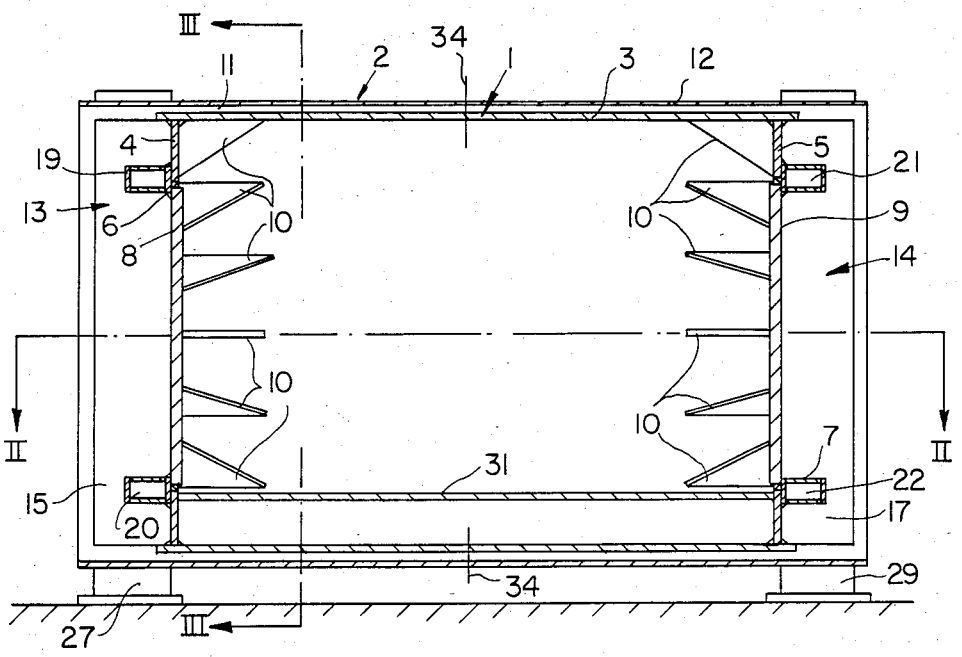
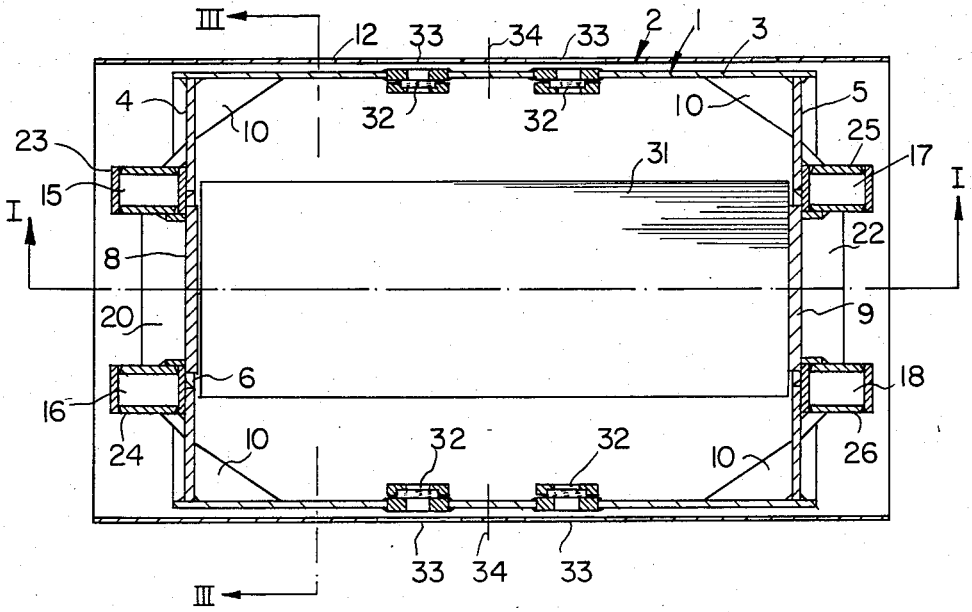
FIG. 2

FIG. 3
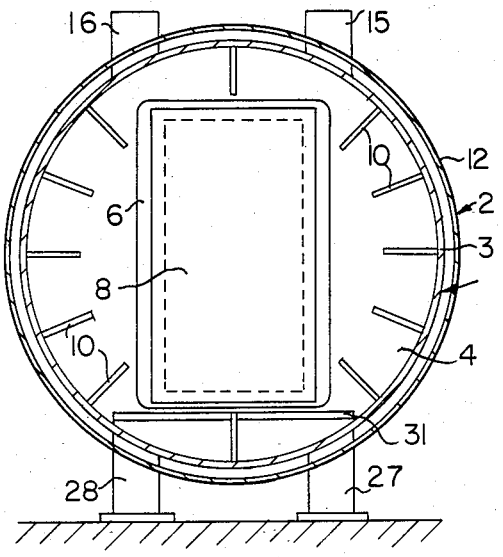
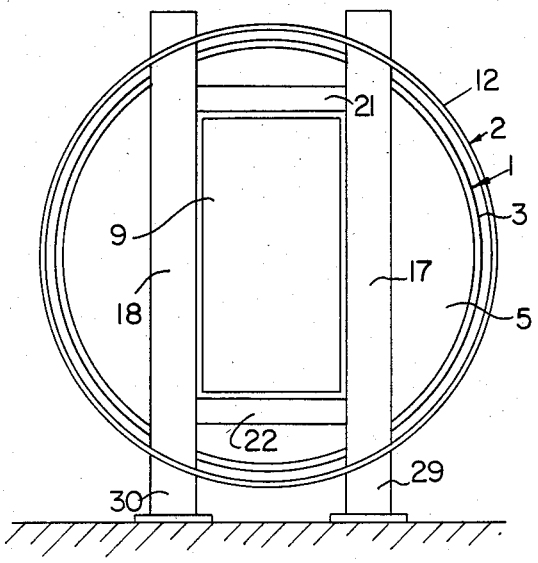
FIG. 4

BLASTING CHAMBER

This invention relates to a cylindrical container or chamber which can contain pressure and fragments produced by an explosion such as a deflagration or a detonation. The container according to the invention is intended to protect the surrounding area by containing critical manufacturing operations for the production of explosive substances, as a test bunker for such explosive substances and fragment production weapons and as a storage for explosive substances as such. Containers and chambers of the above mentioned type will be designated as "blasting chambers" in the text below.

Today blasting chambers are almost without exception heavy concrete bunkers and thick walled steel containers. A few lighter designs have however been made in the last few years. Concrete bunkers usually give the necessary protection but their heavy weight has made it necessary to locate them at or below the ground level and they can only be made mobile by the aid of very heavy vehicles. A more modern and lighter design with a double-walled steel construction with an intermediate shock absorbant layer of a plastic material to prevent the walls from vibrating in phase is described in our own U K Pat. No. 2.084.047. Another example of a lightweight blasting chamber is the cylindrical single walled blasting chamber with reinforced end walls described in our own Swedish Patent Application No. 8105585-7.

The most important advantage with these light weight blasting chambers is their lower weight when compared with the previous types of concrete bunkers. Such a low weight blasting chamber is no longer restricted to the ground level. They can be placed at any height above the ground level as dictated by other reasons than the weight of the chamber. They can also be made mobile without any particular problems. The possibility of placing a blasting chamber at any height above the ground level is particularly interesting when a single dangerous process step in an otherwise safe process has to be enclosed.

The present apparatus, when compared with the apparatus described in our above mentioned patent and patent application, is primarily cheaper and more easy to manufacture and secondly so designed that it is possible to chance an overstrain of the interior part of the blasting chamber in particularly important cases without exposing the surrounding area to an unallowable danger. The blasting chamber according to the invention is a double wall design, at least along its weakest parts, with an exterior part which can take over the load (stress) if the interior part cannot completely stand said load (stress). One advantage of the design according to the invention is that a possibly damaged interior part may be replaced by a new interior part in comparative ease.

The blasting chamber according to the invention is an example of new thinking within the field of the physical properties for such designs. It is so designed that the load (stress), with which the increase of pressure from the explosion is acting upon the interior part of the blasting chamber, is directly distributed between said interior part and said exterior part of the blasting chamber. It has been otherwise quite common in double wall designs for the interior shell (hull) to take the whole load (stress) with only a direct or indirect support from the exterior shell (hull). The distribution of the load (stress), with which the increase of pressure acts upon the interior part, has been attained by securing the interior part of the blasting chamber at the end walls thereof between girder devices which are arranged outside said end walls and directly secured to the jacket wall of the exterior part. Said girder devices thus will transfer (transmit) the load, with which an explosion acts upon the interior part directly to the jacket wall of the exterior part. The jacket walls of the interior and exterior parts are furthermore arranged at some distance from each other so that they do not encounter the risk of vibrating in phase after the explosion.

Both the interior part and the exterior part of the blasting chamber are provided with cylindrical jacket walls which, at least at the interior part at each end thereof, are closed by end walls which are welded to said jacket wall. Said interior part is secured within the jacket wall of the exterior part with some play between the jacket walls. The interior part is secured between girder devices by the aid of bolts, rivets or welding. Said girder devices are secured between the facing surfaces of the jacket wall of the exterior part. Said girder devices are thus spaced from the edge of jacket wall of the exterior part. Potential doors or shutters as access means to the interior part are arranged between the different parts of the girder devices so that said devices can take any load (stress) on the doors or shutters. Said doors or shutters always open into the interior of the blasting chamber. Certain radially arranged reinforcement members, which can transfer loads (stresses) between the end walls of the interior part and the jacket wall thereof, are arranged between such sections of said end walls which extend outside the girder devices and the adjacent jacket wall.

The apparatus according to the invention briefly results in the main part of the pressure loads (stresses) which work on the end walls of the interior part by the aid of said girder devices being transformed into tensile stresses in the jacket of the exterior part. The pressure loads (stresses) which work on the sections of the end walls of the interior part situated outside the girder device and the radial loads (stresses) which work on the jacket wall of said interior part have however to be taken up by said interior part alone. The radially arranged reinforcement members thereby balance the actual loads (stresses) between the end walls and the jacket wall.

The above discussed invention will now be described more closely together with the example shown on the attached drawings.

FIG. 1 is a side elevation section view of a blasting chamber according to the invention.

FIG. 2 is a plan section view of the chamber according to FIG. 1.

FIG. 3 is a section view according to line III—III of FIG. 1.

FIG. 4 is an end view of the blasting chamber according to FIG. 1.

The blasting chamber according to the FIGS. 1–4 comprises an interior part 1 and an exterior part 2. The interior part consists of a tubular or cylindrical jacket wall 3, two end walls 4, 5 each of which is provided with a central opening 6, 7 provided with doors or shutters which are openable into the interior of said chamber. A certain number of triangular reinforcement members 10 are welded along the corner joints between the jacket wall 3 and the end walls 4, 5. The interior part 1 is, as shown on the figures, enclosed within the exterior part 2 with a certain gap 11 between its own jacket wall 3 and the jacket wall 12 of the exterior part. Girder structure 13 consists of two vertical girders 15, 16 and two horizontal girders 19, 20, and girder structure 14 consists of two vertical girders 17, 18 and two horizontal girders 21, 22. Said girders within each system are welded together for very strong framework. Said vertically arranged girders are furthermore drawn through suitable openings 23–26 in the jacket wall 12 of the exterior part 2. The girders are welded to said jacket wall around said openings 23–26. Said interior part 1 is secured between the girder devices 13, 14 and welded or fastened by bolts to said girders. The doors or shutters 8, 9 are fastened to said girders on the interior sides thereof which face each other. These doors are opened towards the interior of the blasting chamber and are larger than the distance between said girders. The door openings 6 and 7 in the end walls 4, 5 are on the other hand larger than said doors so that they do not transfer vibrations directly between them. The vertically arranged girders 15, 16 and 17, 18 form outside the jacket wall 12 of the exterior part 2 four different feet for the support of the blasting chamber. Said girders may also be extended above said jacket wall to another four fixing points.

The blasting chamber is also provided with a lattice work floor 31 which is only partly drawn on FIG. 2. The jacket wall 2 of the interior part 1 is provided with four safety windows 32. The jacket wall 12 of the exterior part is also provided with four openings 33 adjusted to said windows 32. The openings 33 may very well be covered by safety windows as well. If the interior part is damaged so severely that it has to be replaced, the jacket wall 12 of the exterior part 2 is cut along the dotted line 34 and the old interior part is removed and replaced by a new interior part. The two halves of the exterior part are then put together and welded to each other and the new interior part is fastened to the girders as already described.

The physical properties of the device described above can be calculated with a great accuracy for different loads (stresses). The blasting chamber according to the figures was made of 60 mm steel sheets for the doors, 50 mm steel sheets for the girders, 40 mm steel sheets for the jacket wall of the interior part, the end walls and the reinforcement members and 20 mm steel sheets for the jacket wall of the exterior part. The steel quality used is named OX 602. The blasting chamber described above has both theoretically and through tests shown to be particularly suitable to contain explosions producing fragments.

I claim:

1. Apparatus for containing high pressure and fragments produced by an explosion comprising:

an inner chamber comprising a sheet steel cylindrical side wall and sheet steel end walls;

an outer jacket comprising an open-ended sheet steel cylindrical shell surrounding and spaced from said cylindrical side wall of said chamber; and means for transmitting pressure loads from said end walls of said chamber to said cylindrical shell of said jacket.

2. Apparatus in accordance with claim 1 wherein said means for transmitting pressure from the end walls of the inner chamber to the cylindrical shell of the jacket comprises at least one steel girder which extends across and is secured to each end wall and further is secured to the outer jacket.

3. Apparatus in accordance with claim 2 wherein the cylindrical shell of the outer jacket extends past said girders, and the girders extend through the cylindrical shell.

4. Apparatus in accordance with claim 3 wherein said girders extend across the outside of the end walls and are welded or bolted to said end walls.

5. Apparatus in accordance with claim 4 wherein radially arranged triangular reinforcement means are disposed at the intersection of the cylindrical side wall and the end walls of said chamber.

6. Apparatus in accordance with claim 2, 3, 4 or 5 wherein each of the end walls of the chamber is provided with a door openable to the interior of said chamber, said door being disposed within an area in each end wall enclosed by said girder(s) and supported, when closed, by said girder(s).

7. Apparatus in accordance with claim 6 wherein said door and openings in the end walls for said door are separated by a gap, and said gap is bridged by said girders.

8. Apparatus in accordance with claim 1, 2, 3, 4 or 5 wherein said cylindrical side wall of said chamber is the weakest part of said chamber.

9. Apparatus in accordance with claim 6 wherein said cylindrical side wall of said chamber is the weakest part of said chamber.

* * * * *